US010293597B2

(12) United States Patent
Hirano et al.

(10) Patent No.: US 10,293,597 B2
(45) Date of Patent: May 21, 2019

(54) TABLET PRINTING APPARATUS

(71) Applicant: SHIBAURA MECHATRONICS CORPORATION, Yokohama-shi (JP)

(72) Inventors: Azusa Hirano, Yokohama (JP); Yasutsugu Tsuruoka, Yokohama (JP); Yuki Umemura, Yokohama (JP); Junsuke Komito, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 15/897,513

(22) Filed: Feb. 15, 2018

(65) Prior Publication Data

US 2018/0229493 A1 Aug. 16, 2018

(30) Foreign Application Priority Data

Feb. 16, 2017 (JP) ..... 2017-026949
Jan. 24, 2018 (JP) ..... 2018-009625

(51) Int. Cl.
*B41J 3/407* (2006.01)
*B41F 17/36* (2006.01)
(Continued)

(52) U.S. Cl.
CPC ..... *B41F 17/36* (2013.01); *A61J 3/007* (2013.01); *B41J 2/145* (2013.01); *B41J 2/165* (2013.01);
(Continued)

(58) Field of Classification Search
CPC ..... B41F 17/36; B41J 3/407; B41J 11/0085; B41J 11/007; B41J 2/165; B41J 13/08; B41J 2/145; B41J 13/0009; B41M 5/0088; A61J 3/007; A61J 2205/50; A61K 9/20
See application file for complete search history.

(56) References Cited

U.S. PATENT DOCUMENTS 9,108,413 B2 * 8/2015 Takeuchi ..... B41J 2/1433
9,108,431 B2 * 8/2015 Hara ..... B41J 3/407
(Continued)

FOREIGN PATENT DOCUMENTS

JP 02-179761 * 7/1990 ..... B41J 2/18
JP 07-081050 3/1995
(Continued)

OTHER PUBLICATIONS

Computer-generated translation of JP 2017-000534, published on Jan. 2017.*
(Continued)

*Primary Examiner* — Huan H Tran
(74) *Attorney, Agent, or Firm* — Oblon, McClelland, Maier & Neustadt, L.L.P.

(57) ABSTRACT

According to one embodiment, a tablet printing apparatus includes: a conveyor belt that includes a suction hole connected to a suction chamber, and conveys a tablet while sucking the tablet to the suction hole; an ink jet print head that has a nozzle surface where a nozzle is formed, and is located above the conveyor belt such that the nozzle surface faces the conveyor belt, and performs printing on the tablet conveyed by the conveyor belt; and a control plate that is located on the upstream side of the print head in the conveying direction of the tablet between the conveyor belt and the height position of the nozzle surface of the print head, and controls an airflow generated between the conveyor belt and the print head.

14 Claims, 10 Drawing Sheets

(51) Int. Cl.

| | |
|---|---|
| ***B41J 2/145*** | (2006.01) |
| ***B41J 13/08*** | (2006.01) |
| ***B41J 13/00*** | (2006.01) |
| ***B41J 2/165*** | (2006.01) |
| ***A61J 3/00*** | (2006.01) |
| ***B41J 11/00*** | (2006.01) |
| *B41M 5/00* | (2006.01) |

(52) U.S. Cl.

CPC ..... *B41J 3/407* (2013.01); *B41J 11/007* (2013.01); *B41J 11/0085* (2013.01); *B41J 13/0009* (2013.01); *B41J 13/08* (2013.01); *A61J 2200/70* (2013.01); *A61J 2205/50* (2013.01); *B41M 5/0088* (2013.01)

(56) References Cited

U.S. PATENT DOCUMENTS

2003/0177919 A1* 9/2003 Volder ..... B41F 17/36 101/41
2007/0194034 A1* 8/2007 Vasiadis ..... A61J 3/007 221/21
2015/0109364 A1* 4/2015 Miller ..... B41J 2/01 347/20
2016/0016830 A1* 1/2016 Gummer ..... C02F 1/325 210/192
2018/0086059 A1* 3/2018 Ikuta ..... A61J 3/06
2018/0154659 A1* 6/2018 Ogimoto ..... A61J 3/06
2018/0194132 A1* 7/2018 Hirano ..... A61J 3/06

FOREIGN PATENT DOCUMENTS

JP 2006-315226 * 11/2006 ..... B41J 2/18
JP 2017-000534 * 1/2017 ..... A61J 3/06
WO WO 2016/194761 * 12/2016 ..... A61J 3/06

OTHER PUBLICATIONS

Computer-generated translation of JP 2006-315226, published on Nov. 2006.*

* cited by examiner

FIG.5

| | RESULT | JUDGE |
|---|---|---|
| WITHOUT CONTROL PLATE | LARGE AMOUNT OF POWDER ADHERED TO PRINT HEAD PRINTING FAILURE OCCURRED FREQUENTLY | × |
| BLOCKING PLATE | LARGE AMOUNT OF POWDER ADHERED TO PRINT HEAD PRINTING FAILURE OCCURRED FREQUENTLY | × |
| CONTROL PLATE | NO ADHESION TO PRINT HEAD NO PRINTING FAILURE | ○ |

TABLET PRINTING APPARATUS

CROSS-REFERENCE TO THE RELATED APPLICATION

This application is based upon and claims the benefit of priority from Japanese Patent Applications No. 2017-026949, filed on Feb. 16, 2017 and No. 2018-009625, filed on Jan. 24, 2018; the entire contents of all of which are incorporated herein by reference.

FIELD

Embodiments described herein relate generally to a tablet printing apparatus.

BACKGROUND

A technique that uses an inkjet print head to preform printing is known for printing identification information such as characters, letters, marks or the like on a tablet. In the tablet printing apparatus using this technique, tablets are conveyed by a tablet conveying device such as a conveyor. Ink (for example, edible ink) is ejected from a nozzle of the inkjet print head located above the tablet conveying device toward each tablet passing under the print head to print identification information on the tablet. As a tablet conveying device, a device that sucks and holds tablets on a conveyor belt has been developed. A plurality of suction holes of, for example, circular or rectangular shape are arranged so as to line up in the conveying direction of the tablets in the conveyor belt of the suction type tablet conveying device to suck and hold the tablets.

In the conveyor belt of the suction type tablet conveying device, tablets supplied onto the suction holes are held on the conveyor belt by suction from the suction holes. However, there are cases where the suction hole is not completely closed by the tablet. That is, a portion of the suction hole may not be closed depending on the size, shape, posture, or the like of the tablet. Besides, the suction hole may not be closed at all due to random supply of the tablet. When the suction hole is not completely closed by the tablet, an airflow is generated above the suction hole as the air is sucked from the suction hole. When the tablet is being conveyed, the surface of the conveyor belt moves along the conveying direction of the tablet. As a result, an airflow flowing along the conveying direction of the tablet also occurs on the conveyor belt due to the movement of the conveyor belt. Such various airflows are mixed and generate turbulence. Further, when the print head and its surrounding members are located above the conveyor belt, the airflow flowing above the conveyor belt strikes these members, which generates further turbulence.

When an airflow such as the turbulence occurs below the print head or in the vicinity thereof, powder of the tablet adhering to the conveyor belt or the tablet may fly and adhere to the nozzle surface (the surface on which the nozzle is formed) of the print head. If the tablet powder adheres to the nozzle surface, the nozzle may be clogged, resulting in ejection failure, or the ink ejected from the nozzle may not fly normally and land at a position other than a desired position on the tablet, resulting in reduced print quality.

In addition, if an airflow such as the turbulence occurs below the print head or in the vicinity thereof, when the tablet passes under the print head, the tablet sucked and held by the conveyor belt shake due to the turbulence and the posture of the print surface of the tablet cannot be maintained. If the posture of the print surface of the tablet cannot be maintained, the ink may land at a position other than a desired position on the tablet, resulting in reduced print quality.

BRIEF DESCRIPTION OF THE DRAWINGS

FIG. 5 is a diagram illustrating a result of comparison between the tablet printing apparatus of the first embodiment and another tablet printing apparatus;

DETAILED DESCRIPTION

According to one embodiment, a tablet printing apparatus includes: a conveyor belt that includes a suction hole connected to a suction chamber, and conveys a tablet while sucking the tablet to the suction hole; an ink jet print head that has a nozzle surface where a nozzle is formed, and is located above the conveyor belt such that the nozzle surface faces the conveyor belt, and performs printing on the tablet conveyed by the conveyor belt; and a control plate that is located on the upstream side of the print head in the conveying direction of the tablet between the conveyor belt and the height position of the nozzle surface of the print head, and controls an airflow generated between the conveyor belt and the print head.

<First Embodiment>

A first embodiment will be described with reference to FIGS. 1 to 5.

(Basic Configuration)

Figure 1:
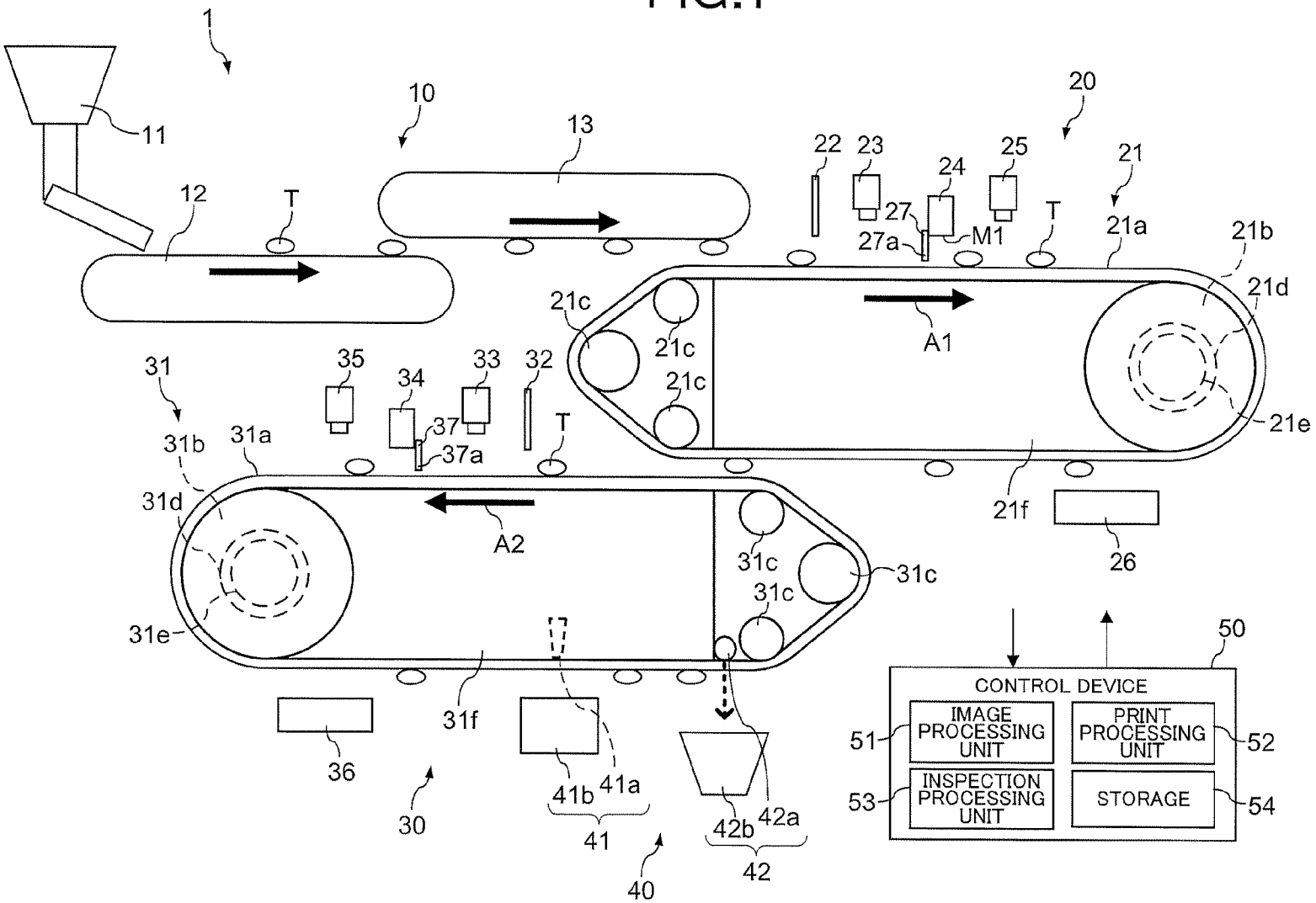
FIG. 1 is a diagram illustrating the schematic configuration of a tablet printing apparatus according to a first embodiment.

As illustrated in FIG. 1, a tablet printing apparatus 1 of the first embodiment includes a supply device 10, a first printing device 20, a second printing device 30, a collecting device 40, and a control device 50. The first printing device 20 and the second printing device 30 basically have the same structure.

The supply device 10 includes a hopper 11, an alignment feeder 12, and a transfer feeder 13. The supply device 10 is configured to be capable of supplying tablets T to be printed to the first printing device 20, and is located on one end side of the first printing device 20. The hopper 11 stores a number of tablets T and sequentially supplies the tablets T to the alignment feeder 12. The alignment feeder 12 aligns the supplied tablets T in two rows and conveys them to the transfer feeder 13. The transfer feeder 13 sequentially sucks the tablets T on the alignment feeder 12 and conveys them in two rows to the first printing device 20. The transfer feeder 13 supplies the first printing device 20 with the tablets T in two rows. The supply device 10 is electrically connected to the control device 50, and is driven under the control of the control device 50. As the alignment feeder 12 and the transfer feeder 13, for example, a belt conveying mechanism can be used. Incidentally, the tablet T to be printed is in a three-dimensional shape and has a thickness.

The first printing device 20 includes a conveying device (tablet conveying device) 21, a detecting device 22, a first imaging device (imaging device for printing) 23, a print head device 24, a second imaging device (imaging device for inspection) 25, and a drying device 26.

The conveying device 21 includes a conveyor belt 21*a*, a pulley body 21*b* as a driving pulley, a plurality of driven pulleys 21*c* (three in the example of FIG. 1), a motor (driving unit) 21*d*, a position detector 21*e*, and a suction chamber 21*f*. The conveyor belt 21*a* is formed to be endless and wrapped around the pulley body 21*b* and each of the driven pulleys 21*c*. The pulley body 21*b* and the driven pulleys 21*c* are rotatably provided to the apparatus main body, and the pulley body 21*b* is connected to the motor 21*d*. The motor 21*d* is electrically connected to the control device 50, and is driven under the control of the control device 50. The position detector 21*e* is a device such as an encoder and is attached to the motor 21*d*. The position detector 21*e* is electrically connected to the control device 50, and sends a detection signal to the control device 50. The control device 50 can obtain information such as the position, speed, and movement amount of the conveyor belt 21*a* based on the detection signal. In the conveying device 21, the conveyor belt 21*a* is rotated together with the driven pulleys 21*c* due to the rotation of the pulley body 21*b* by the motor 21*d*, and the tablets T on the conveyor belt 21*a* are conveyed in the direction of the arrow A1 in FIGS. 1 and 2 (conveying direction A1).

Figure 2:
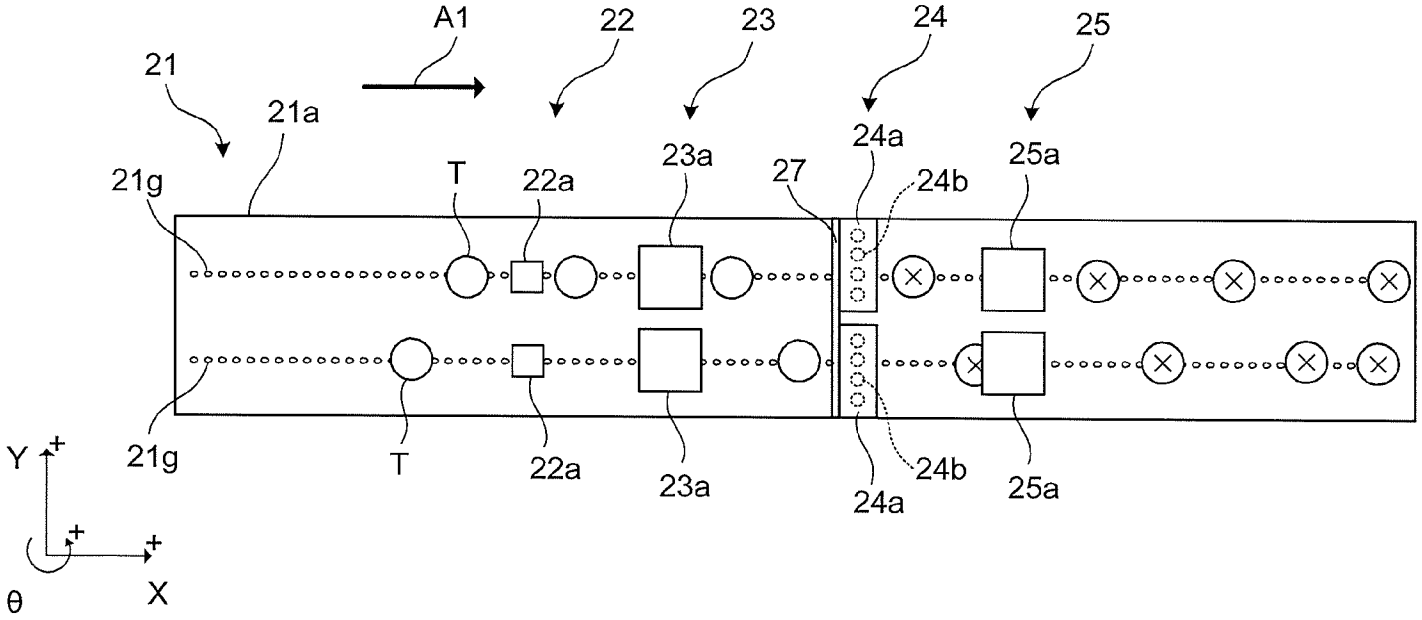
FIG. 2 is a plan view illustrating a part of a first printing device of the first embodiment.

As illustrated in FIG. 2, a plurality of circular suction holes 21*g* are formed on the surface of the conveyor belt 21*a*. The suction holes 21*g* are through holes for sucking and holding each of the tablets T, and are arranged in two rows in parallel along the conveying direction A1 so as to form two conveying paths. Each of the suction holes 21*g* is connected to the suction chamber 21*f* (see FIG. 1) to obtain suction force from the suction chamber 21*f*. The suction chamber 21*f* is configured to give (apply) suction force to the tablets T placed in the suction holes 21*g* of the conveyor belt 21*a*. A suction device such as a pump is connected to the suction chamber 21*f* via a suction pipe (not illustrated), and the inside of the suction chamber 21*f* is depressurized by the operation of the suction device. The suction pipe is connected to substantially the center of a side surface (a surface parallel to the conveying direction A1) of the suction chamber 21*f*. The suction device is electrically connected to the control device 50, and is driven under the control of the control device 50.

The detecting device 22 includes a plurality of detectors 22*a* (two in the example of FIG. 2). Each of the detectors 22*a* is arranged on the downstream side in the conveying direction A1 from the position where the tablet T on the conveyor belt 21*a* is supplied by the supply device 10 for each conveying path of the tablets T in a direction intersecting the conveying direction A1 in the horizontal plane (for example, a direction perpendicular to the conveying direction A1), and is located above the conveyor belt 21*a*. The detector 22*a* detects the position (the position in the conveying direction A1) of the tablet T on the conveyor belt 21*a* by projecting and receiving laser beams, and functions as a trigger sensor of each device located on the downstream side. As the detector 22*a*, various laser sensors such as a reflection laser sensor can be used. Each of the detectors 22*a* is electrically connected to the control device 50, and sends a detection signal to the control device 50.

The first imaging device 23 includes a plurality of imaging units 23*a* (two in the example of FIG. 2). Each of the imaging units 23*a* is arranged on the downstream side in the conveying direction A1 from the position where the detecting device 22 is provided for each conveying path of the tablets T in a direction intersecting the conveying direction A1 in the horizontal plane (for example, a direction perpendicular to the conveying direction A1), and is located above the conveyor belt 21*a*. The imaging unit 23*a* performs imaging at the time when the tablet T reaches just under the imaging unit 23*a* based on the position information of the tablet T to capture an image (image for printing) including the upper surface of the tablet T, and sends the image to the control device 50. As the imaging unit 23*a*, various cameras having an imaging device such as a charge-coupled device (CCD) or a complementary metal-oxide semiconductor (CMOS) can be used. Each of the imaging units 23*a* is electrically connected to the control device 50, and is driven under the control of the control device 50. There may also be provided an illumination for imaging as necessary.

The print head device 24 includes a plurality of ink jet print heads 24*a* (two in the example of FIG. 2). Each of the print heads 24*a* is arranged on the downstream side in the conveying direction A1 from the position where the first imaging device 23 is provided for each conveying path of the tablets T in a direction intersecting the conveying direction A1 in the horizontal plane (for example, a direction perpendicular to the conveying direction A1), and is located above the conveyor belt 21*a*. The print head 24*a* has a plurality of nozzles 24*b* (see FIG. 2: only four nozzles are illustrated in the figure), and ejects ink individually from each of the nozzles 24*b*. In the print head 24*a*, the surface on which the nozzles 24*b* are formed is the nozzle surface M1 (see FIG. 1). The print head 24*a* is arranged so that the alignment direction of the nozzles 24*b* intersects (for example, orthogonally to) the conveying direction A1 in the horizontal plane. As the print head 24*a*, various ink jet print heads having a drive element such as a piezoelectric element, a heating element, a magnetostrictive element or the like can be used. Each of the print heads 24*a* is electrically connected to the control device 50, and is driven under the control of the control device 50.

The second imaging device 25 includes a plurality of imaging units 25*a* (two in the example of FIG. 2). Each of the imaging units 25*a* is arranged on the downstream side in the conveying direction A1 from the position where the print head device 24 is provided for each conveying path of the tablets T in a direction intersecting the conveying direction A1 in the horizontal plane (for example, a direction perpendicular to the conveying direction A1), and is located above the conveyor belt 21*a*. The imaging unit 25*a* performs imaging at the time when the tablet T reaches just under the imaging unit 25*a* based on the position information of the tablet T to capture an image (image for inspection) including the upper surface of the tablet T, and sends the image to the control device 50. Similarly to the imaging unit 23*a*, as the imaging unit 25*a*, various cameras having an imaging device such as CCD or CMOS can be used. Each of the imaging units 25*a* is electrically connected to the control device 50, and is driven under the control of the control device 50. There may also be provided an illumination for imaging as necessary.

Referring back to FIG. 1, the drying device 26 is located downstream of the set position of the second imaging device 25 in the conveying direction A1, and is located, for example, below the conveying device 21. The drying device 26 is shared in the two conveying paths, and is configured to dry the ink applied to each tablet T on the conveyor belt 21*a*. As the drying device 26, various types of drying units such as a heater for drying an object to be dried by radiation heat, a blower for drying an object to be dried with worm air or hot air, and the like can be used. The drying device 26 is electrically connected to the control device 50, and is driven under the control of the control device 50.

The tablet T passing above the drying device 26 is conveyed along with the movement of the conveyor belt 21*a* and reaches a position near an end portion of the conveyor belt 21*a* on the driven pulley 21*c* side. At this position, the suction does not work on the tablet T. The tablet T is released from the hold of the conveyor belt 21*a*, and is transferred from the first printing device 20 to the second printing device 30.

The second printing device 30 includes a conveying device 31, a detecting device 32, a first imaging device (imaging device for printing) 33, a print head device 34, a second imaging device (imaging device for inspection) 35, and a drying device 36. The conveying device 31 includes a conveyor belt 31*a*, a pulley body 31*b* as a driving pulley, a plurality of driven pulleys 31*c* (three in the example of FIG. 1), a motor (driving unit) 31*d*, a position detector 31*e*, and a suction chamber 31*f*. Each constituent element of the second printing device 30 has basically the same structure as the corresponding constituent element of the first printing device 20 described above. Therefore, the explanation will be omitted. The conveying direction of the second printing device 30 is the direction of the arrow A2 (conveying direction A2) in FIG. 1.

The collecting device 40 includes a defective product collecting device 41 and a non-defective product collecting device 42. The collecting device 40 is located on the downstream side in the conveying direction A2 from the set position of the drying device 36 of the second printing device 30. The collecting device 40 collects defective tablets T by the defective product collecting device 41 and collects good tablets T by the non-defective product collecting device 42.

The defective product collecting device 41 includes an injection nozzle 41*a* and a housing 41*b*. The injection nozzle 41*a* is provided in the suction chamber 31*f* of the second printing device 30. The injection nozzle 41*a* injects a gas (for example, air) toward the tablet T (defective tablet T) conveyed by the conveyor belt 31*a* such that the tablet T is dropped from the conveyor belt 31*a*. At this time, the gas injected from the injection nozzle 41*a* passes through the suction holes (similar to the suction holes 21*g* illustrated in FIG. 2) of the conveyor belt 31*a* and hits the tablet T. The injection nozzle 41*a* is electrically connected to the control device 50, and is driven under the control of the control device 50. The housing 41*b* receives and stores the tablet T dropped from the conveyor belt 31*a*.

The non-defective product collecting device 42 includes a gas blower 42*a* and a housing 42*b*. The non-defective product collecting device 42 is located on the downstream side in the conveying direction A2 from the set position of the defective product collecting device 41. The gas blower 42*a* is provided at the end portion of the conveying device 31 in the conveying device 31 of the second printing device 30, that is, at the end portion of the conveyor belt 31*a* on the driven pulleys 31*c* side. During the printing process, for example, the gas blower 42*a* constantly blows a gas (for example, air) toward the conveyor belt 31*a* to drop the tablet T from the conveyor belt 31*a*. At this time, the gas blown out from the gas blower 42*a* passes through the suction holes (similar to the suction holes 21*g* illustrated in FIG. 2) of the conveyor belt 31*a* and hits the tablet T. Examples of the gas blower 42*a* include an air blow having a slit-shaped opening extending in a direction intersecting the conveying direction A2 in the horizontal plane (for example, a direction perpendicular to the conveying direction A2) in the conveying direction A2. The gas blower 42*a* is electrically connected to the control device 50, and is driven under the control of the control device 50. The housing 42*b* receives and stores the tablet T dropped from the conveyor belt 31*a*.

The tablet T having passed through the defective product collecting device 41 is conveyed along with the movement of the conveyor belt 31*a*, and reaches a position near the end portion of the conveyor belt 31*a* on the driven pulleys 31*c* side. At this position, the suction does not work on the tablet T. However, with the gas blower 42*a*, the tablet T can be reliably dropped from the conveyor belt 31*a* and collected in the housing 42*b*.

The control device 50 includes an image processing unit 51, a print processing unit 52, an inspection processing unit 53, and a storage 54. The image processing unit 51 processes an image. The print processing unit 52 performs processing related to printing. The inspection processing unit 53 performs processing related to inspection. The storage 54 stores various information such as processing information and various programs. The control device 50 controls the supply device 10, the first printing device 20, and the second printing device 30. The control device 50 receives position information of the tablets T sent from each of the detecting devices 22 and 32 of the first printing device 20 and the second printing device 30, images sent from each of the imaging devices 23, 25, 33 and 35 of the first printing device 20 and the second printing device 30, and the like.

(Control Plate)

As illustrated in FIGS. 1 and 2, each of the print heads 24*a* of the print head device 24 is provided with a common control plate 27. The control plate 27 will be described with reference to FIGS. 3 and 4. A control plate 37 (see FIG. 1) for the print head device 34 of the second printing device 30 is of basically the same structure, and therefore the description thereof will be omitted.

Figure 3:
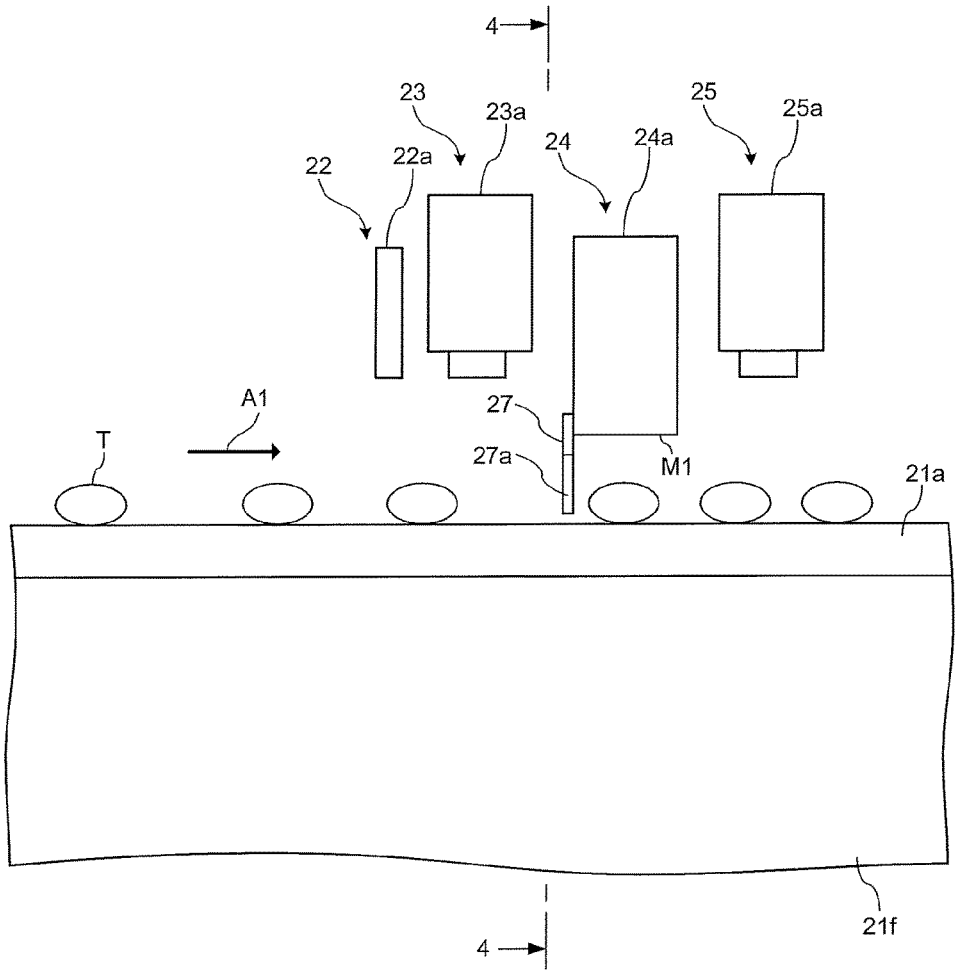
FIG. 3 is a diagram illustrating a part of the first printing device of the first embodiment.
Figure 4:
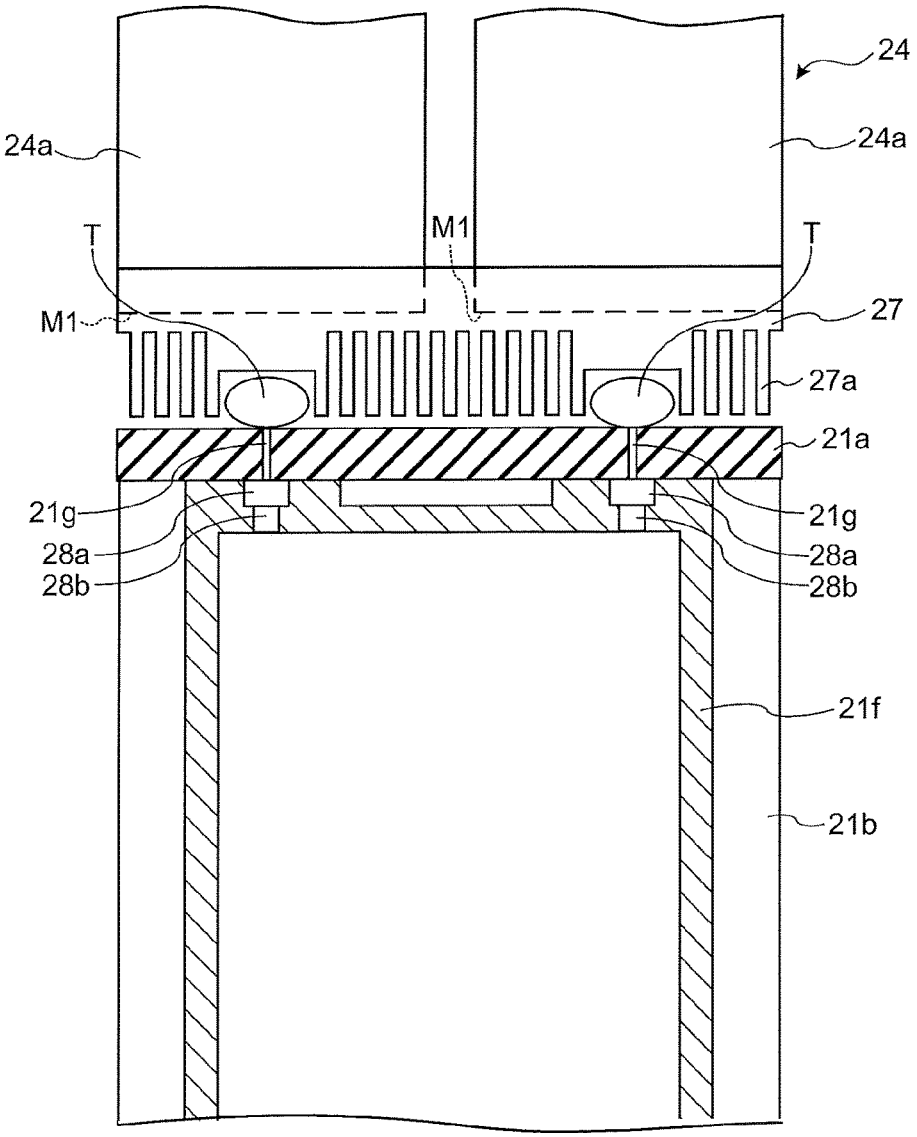
FIG. 4 is a cross-sectional view taken along the line 4-4 in FIG. 3.

As illustrated in FIGS. 3 and 4, the control plate 27 is formed in, for example, a rectangular plate shape. The longitudinal direction of the control plate 27 is set in a direction perpendicular to the conveying direction A1 of the tablet T in the horizontal plane. Further, the control plate 27 is set perpendicular to the lower surface (nozzle surface M1) of each of the print heads 24*a*, and is arranged on a surface of each of the print heads 24*a* on the upstream side in the conveying direction A1 (conveying direction upstream side). The control plate 27 is located between the height position of the nozzle surface M1 of the print heads 24*a* and the conveyor belt 21*a*. An end portion of the control plate 27 on the conveyor belt 21*a* side is formed in a comb shape having a plurality of comb teeth 27*a* arranged in a direction perpendicular to the conveying direction A1 in the horizontal plane. Each of the comb teeth 27*a* is formed into, for example, a quadrangular prism shape. The control plate 27 is located on the upstream side of each of the print heads 24*a* in the conveying direction A1 and controls an airflow generated between the conveyor belt 21*a* and each of the print heads 24*a*.

The length of the control plate 27 in the longitudinal direction (the length in a direction perpendicular to the conveying direction A1 in the horizontal plane) is equal to or longer than the length of the row of all the nozzles 24*b* of each of the print heads 24*a*. The thickness of the control plate 27, that is, the length in the short side direction (the length in a direction along the conveying direction A1) is, for example, about 2 mm. The vertical distance between the lower end of the comb teeth 27*a* and the upper surface of the conveyor belt 21*a* is, for example, about 1 mm. The lower end of the comb teeth 27*a* is higher than the upper surface of the conveyor belt 21*a*, and lower than the apex of the tablet T placed on the upper surface of the conveyor belt 21*a*. The length of the comb teeth 27*a* in the short side direction (the length in a direction perpendicular to the conveying direction A1 in the horizontal plane) is, for example, about 2 mm. The horizontal distance between two adjacent teeth of the comb teeth 27*a*, which sandwich the tablet T conveyed by the conveyor belt 21*a*, depends on the diameter of the tablet T to be printed (an example of the maximum size of the tablet T in the horizontal direction) and is larger than the diameter. That is, the control plate 27 is shaped so as not to hit the tablet T conveyed by the conveyor belt 21*a*. The diameter of the tablet T varies depending on the type of the tablet T, and may be, for example, about 5 mm to 12 mm.

A metal such as stainless steel (SUS) can be used as a material of the control plate 27. The control plate 27 may be made of any material other than SUS such as, for example, aluminum or resin as long as that conforms to the Food Sanitation Law.

In this embodiment, only one control plate 27 is provided to be shared by the print heads 24*a* arranged in two rows; however, it is not so limited. Control plates 27 may be provided one for each of the print heads 24*a*. Besides, all of the comb teeth 27*a* are formed in a quadrangular prism shape; however, it is not so limited. The comb teeth 27*a* may be formed in, for example, a triangular prism shape, a hexagonal prism shape, a cylindrical shape, or an elliptic cylinder shape. In addition, all of the comb teeth 27*a* need not necessarily be formed in the same shape, and a part of the comb teeth 27*a* may have a different shape, or the comb teeth 27*a* may each have a different shape.

As illustrated in FIG. 4, each of the suction holes 21*g* of the conveyor belt 21*a* is connected to the inside of the suction chamber 21*f* via a groove 28*a* formed in the suction chamber 21*f* and a plurality of through holes 28*b*. The groove 28*a* is formed for each conveying path of the tablet T so as to be located immediately below each of the suction holes 21*g* of the conveyor belt 21*a* wrapped around the pulley body 21*b* and the driven pulleys 21*c*. Each of the through holes 28*b* is formed in the bottom surface of the groove 28*a* so as to be aligned in the conveying direction A1. When the inside of the suction chamber 21*f* is sucked, the tablets T on the suction holes 21*g* are sucked through the groove 28*a* and the through holes 28*b*.

As illustrated in FIG. 4, the longitudinal length of the control plate 27 (the length in a direction perpendicular to the conveying direction A1 in the horizontal plane) is equal to or longer than the length of the tablet T to be printed in the same direction (the length in a direction perpendicular to the conveying direction A1 in the horizontal plane). Therefore, when the tablet T is conveyed while being sucked on the suction hole 21*g*, the conveying path is covered by the control plate 27 when the tablet T passes under the control plate 27. In addition, for example, when the tablet T has a disc shape, the "length in the same direction" corresponds to the diameter of the tablet T.

(Printing Process)

Next, a description will be given of printing process and inspection process performed by the tablet printing apparatus 1.

First, various information such as print data required for printing is stored in the storage 54 of the control device 50. Then, when a number of tablets T to be printed are put in the hopper 11 of the supply device 10, the tablets T are sequentially supplied from the hopper 11 to the alignment feeder 12, and moved as being aligned in two rows by the alignment feeder 12. The tablets T moving in two rows are sequentially supplied to the conveyor belt 21*a* by the transfer feeder 13. The conveyor belt 21*a* is rotating in the conveying direction A1 with the rotation of the pulley body 21*b* and the driven pulleys 21*c* by the motor 21*d*. Accordingly, the tablets T supplied onto the conveyor belt 21*a* are conveyed at a predetermined moving speed in two rows on the conveyor belt 21*a*. The conveyor belt 31*a* is also rotated in the conveying direction A2 with the rotation of the pulley body 31*b* and the driven pulleys 31*c* by the motor 31*d*.

Thereafter, the tablet T on the conveyor belt 21*a* is detected by the detecting device 22. Thereby, position information (the position in the conveying direction A1) of the tablet T is acquired and input to the control device 50. The position information of the tablet T is stored in the storage 54 and used for post-processing. Next, an image of the tablet T on the conveyor belt 21*a* is captured by the first imaging device 23 at the timing based on the position information of the tablet T, and the image captured is sent to the control device 50. Based on each image sent from the first imaging device 23, positional shift information of the tablet T (for example, positional shift of the tablet T in the X direction, the Y direction, and the θ direction) is generated by the image processing unit 51, and is stored in the storage 54. Based on the positional shift information of the tablet T, printing conditions (ejection position and ejection speed of the ink) for the tablet T are set by the print processing unit 52 and stored in the storage 54.

Subsequently, the print head device 24 performs printing on each of the tablets T on the conveyor belt 21*a* based on the printing conditions at the timing based on the position information of the tablet T, that is, at the timing when the tablet T reaches below the print head device 24. In each of the print heads 24*a* of the print head device 24, ink is appropriately ejected from each of the nozzles 24*b*, Thus, identification information such as a letter (for example, alphabet, kana, number), a mark (for example, symbol or figure), or the like is printed on the top surface of the tablets T.

The tablet T on which the identification information is printed is imaged by the second imaging device 25 at the timing based on the position information of the tablet T, and the image is sent to the control device 50. The image processing unit 51 generates print position information indicating the print position of the print pattern for each tablet T based on each image sent from the second imaging device 25. The print position information is stored in the storage 54. The inspection processing unit 53 determines whether the printing on the tablet T is acceptable based on the print position information, and print quality determination result information indicating the result of print quality determination is stored in the storage 54 for each tablet T.

For example, it is determined whether the print pattern is printed at a predetermined position of the tablet T.

The tablet T after the inspection is conveyed along with the movement of the conveyor belt 21*a* and passes above the drying device 26. At this time, the drying device 26 dries the ink applied to the tablet T while the tablet T is passing above the drying device 26. The tablet T where the ink has dried is conveyed with the movement of the conveyor belt 21*a* and is located near the end portion of the conveyor belt 21*a* on the driven pulley 21*c* side. At this position, the suction no longer works on the tablet T. The tablet T is released from the hold of the conveyor belt 21*a*, and is transferred from the first printing device 20 to the second printing device 30.

After that, the printing process and the inspection process are performed in the same manner as described above also in the second printing device 30. The tablet T after the inspection is conveyed with the movement of the conveyor belt 31*a* and passes above the drying device 36. Then, the tablet T with the ink dried reaches the defective product collecting device 41. The defective tablet T is dropped from the conveyor belt 31*a* by the gas ejected from the injection nozzle 41*a* and collected in the housing 41*b*. On the other hand, the non-defective tablet T passes through the defective product collecting device 41 and reaches the non-defective product collecting device 42. At this position, the suction does not work on the tablet T, and the non-defective tablet T drops away from the conveyor belt 31*a* by the gas blown out from the gas blower 42*a*, and is collected in the housing 42*b*.

In the printing process, the tablet T supplied onto the suction hole 21*g* is held on the conveyor belt 21*a* by suction from the suction hole 21*g*. However, the suction hole 21*g* may not be completely closed by the tablet T. In this case, since air is sucked from the suction hole 21*g*, an airflow is generated above the suction hole 21*g*. When the tablet T is conveyed, an airflow flowing above the conveyor belt 21*a* also occurs along the conveying direction A1 by the movement of the conveyor belt 21*a*. In addition, if the print head 24*a* and its surrounding members are located above the conveyor belt 21*a*, the airflow flowing above the conveyor belt 21*a* strikes these members, which generates further turbulence.

Although airflows are generated as above, an airflow generated below each of the print heads 24*a* and around it is controlled by the control plate 27. That is, the control plate 27 controls the airflow by having a blocking portion where the airflow generated between the conveyor belt 21*a* and the print head 24*a* along the conveying direction A1 by the movement of the conveyor belt 21*a* is blocked and an opening portion through which the airflow passes. In the example of this embodiment, the comb teeth 27*a* serves as the blocking portion, and a space in the comb teeth 27*a* corresponds to the opening portion. For example, the airflow flowing above the conveyor belt 21*a* along the conveying direction A1 strikes the control plate 27 and passes though the comb teeth 27*a* of the control plate 27. As a result, the airflow generated between the conveyor belt 21*a* and each of the print heads 24*a* is controlled, and powder adhering to the tablet T and the conveyor belt 21*a* is suppressed from being blown by the airflow generated below the print heads 24*a* and its surroundings. Thus, the powder is suppressed from adhering to the lower surface (nozzle surface) of the print heads 24*a*. On the upstream side of the control plate 27, even if the powder adhering to the tablet T and the conveyor belt 21*a* is blown by the airflow, a part of the powder is blocked by the control plate 27. As a result, the powder can be suppressed from adhering to the lower surface of the print head 24*a*.

FIG. 5 illustrates a result of comparison among a conventional tablet printing apparatus not having the control plate 27, a tablet printing apparatus having a blocking plate without the comb teeth 27*a* of the control plate 27, the tablet printing apparatus 1 of this embodiment in which the control plate 27 is made of resin, and the tablet printing apparatus 1 of this embodiment in which the control plate 27 is made of metal when printing was performed on the tablet T for 30 minutes. The amount of powder adhering to the print head 24*a* was visually observed, and the incidence of tablet T with printing failure was also observed.

First, in the conventional tablet printing apparatus not having the control plate 27, a large amount of powder adhered to the print head 24*a*, and there were many tablets T with printing failure.

Next, in the tablet printing apparatus having the blocking plate without the comb teeth 27*a* of the control plate 27, similarly to the conventional tablet printing apparatus, a large amount of powder adhered to the print head 24*a*, and there were many tablets T with printing failure. Presumably, this may be because most of airflows generated above the suction holes 21*g* hit the blocking plate not having the comb teeth 27*a*, resulting in the generation of turbulence, and the flow velocity increased in the space between the blocking plate and the conveyor belt 21*a*, resulting in the further generation of airflows below the print head 24*a*, and thus the powder was blown up.

In the tablet printing apparatus 1 of this embodiment with the resinous control plate 27, the adhesion of powder was scarcely observed on the print head 24*a*, and there was no tablet T having printing failure. Besides, the adhesion of powder was observed on the control plate 27.

In the tablet printing apparatus 1 of this embodiment with the metallic control plate 27, the adhesion of powder was scarcely observed on the print head 24*a*, and there was no tablet T having printing failure. In addition, no adhesion of powder was observed on the control plate 27.

When the tablet T conveyed as being sucked on the conveyor belt 21*a* is swayed by the airflow generated between the conveyor belt 21*a* and each of the print heads 24*a*, the posture of the printing surface of the tablet T may not be maintained. Further, since the tablet T is in a three-dimensional shape and has a thickness, when the tablet T passes under the print head 24*a*, the distance between the nozzle surface M1 of the print head 24*a* and the printing surface of the tablet T is shorter than the distance between the nozzle surface M1 and the upper surface of the conveyor belt 21*a* where the tablet T is not sucked. For example, the distance between the nozzle surface M1 of the print head 24*a* and the printing surface of the tablet T is 20% to 25% (in a range of 20% or more and 25% or less) of the distance between the nozzle surface M1 and the upper surface of the conveyor belt 21*a* where the tablet T is not sucked.

Consequently, the posture of the printing surface of the tablet T is susceptible to turbulence generated by sudden pressure fluctuation caused when the tablet T passes under the print head 24*a* and turbulence generated near the print head 24*a* as a result of the collision of the airflow flowing above the conveyor belt 21*a* with the print head 24*a*. If the posture of the printing surface of the tablet T cannot be maintained due to the influence of such airflow, the print position may be shifted or the print may be blurred, thereby causing a printing failure. Therefore, it is necessary to control the airflow also on the surface of the conveyor belt 21*a* around the print head 24*a*.

As described above, the airflow flowing above the conveyor belt 21*a* along the conveying direction A1 hits the control plate 27 and passes through the opening portion in the control plate 27. This rectifies the airflow flowing above the conveyor belt 21*a* into a laminar flow along the conveying direction A1.

The longitudinal length of the control plate 27 (the length in a direction perpendicular to the conveying direction A1 in the horizontal plane) is equal to or longer than the length of the tablet T to be printed in the same direction (the length in a direction perpendicular to the conveying direction A1 in the horizontal plane). Therefore, the control plate is arranged so as to cover the conveying path of the tablet T on the conveyor belt 21*a*. Thereby, the airflow flowing above the conveyor belt 21*a* can be rectified into a laminar flow along the conveying direction A1.

The control plate 27 is shaped so as not to hit the tablets T conveyed by the conveyor belt 21*a*. A part of the lower end of the control plate 27 is located at a position higher than the upper surface of the conveyor belt 21*a* and lower than the apex of the tablet T on the conveyor belt 21*a*. Thus, it is possible to rectify the airflow around the surface of the conveyor belt 21*a* into a laminar flow without hindering the conveyance of the tablet T.

As described above, according to the first embodiment, the control plate 27 that controls the airflow generated between the conveyor belt 21*a* and the print head 24*a* is located on the upstream side of the print head 24*a* in the conveying direction A1 above the conveyor belt 21*a*. With this, the airflow generated below and around each of the print heads 24*a* is controlled. Thus, the powder adhering to the tablets T and the conveyor belt 21*a* is prevented from being blown by the airflow generated below and around each of the print heads 24*a*. Even if the powder adhering to the tablets T and the conveyor belt 21*a* flies due to the airflow, a part of the powder is blocked by the control plate 27. Thereby, the powder can be prevented from adhering to the lower surface of the print head 24*a*. Therefore, it is possible to suppress the adhesion of the powder of the tablet T to the lower surface of the print head 24*a* as well as to reduce erroneous flight direction and the defective ejection of ink from the print head 24*a*. As a result, a reduction in print quality due to the powder of the tablets T can be suppressed.

Further, it is possible to rectify the airflow on the conveyor belt 21*a* below and around the print head 24*a* into a laminar flow, thereby suppressing the occurrence of turbulence. With this, the shaking of the tablet T sucked and held by the conveyor belt 21*a* can be suppressed. Thus, it is possible to suppress a reduction in print quality due to the inability to maintain the posture of the print surface of the tablet T.

Although the control plate 27 is arranged in the print head 24*a*, it is not so limited. The control plate 27 may be arranged in another member (refer to second and third embodiments below). If the control plate 27 is arranged in the print head 24*a*, when the type of the tablets T to be printed is changed and there is a change in the thickness of the tablets T, by adjusting the height position of the print head 24*a*, the height position of the control plate 27 is automatically adjusted simultaneously with the adjustment of the height position. When the control plate 27 is arranged in a member other than the print head 24*a*, the height position of the print head 24*a* and the height position of the control plate 27 need to be individually adjusted. However, when the control plate 27 is arranged in the print head 24*a*, the height position of the print head 24*a* and the height position of the control plate 27 can be adjusted simultaneously according to the thickness of the tablets T. Thus, effective adjustment can be realized.

<Second Embodiment>

Next, a second embodiment will be described with reference to FIG. 6. The second embodiment is different from the first embodiment in the presence of a cover 60, and the cover 60 will be described. Other explanation will be omitted.

Figure 6:
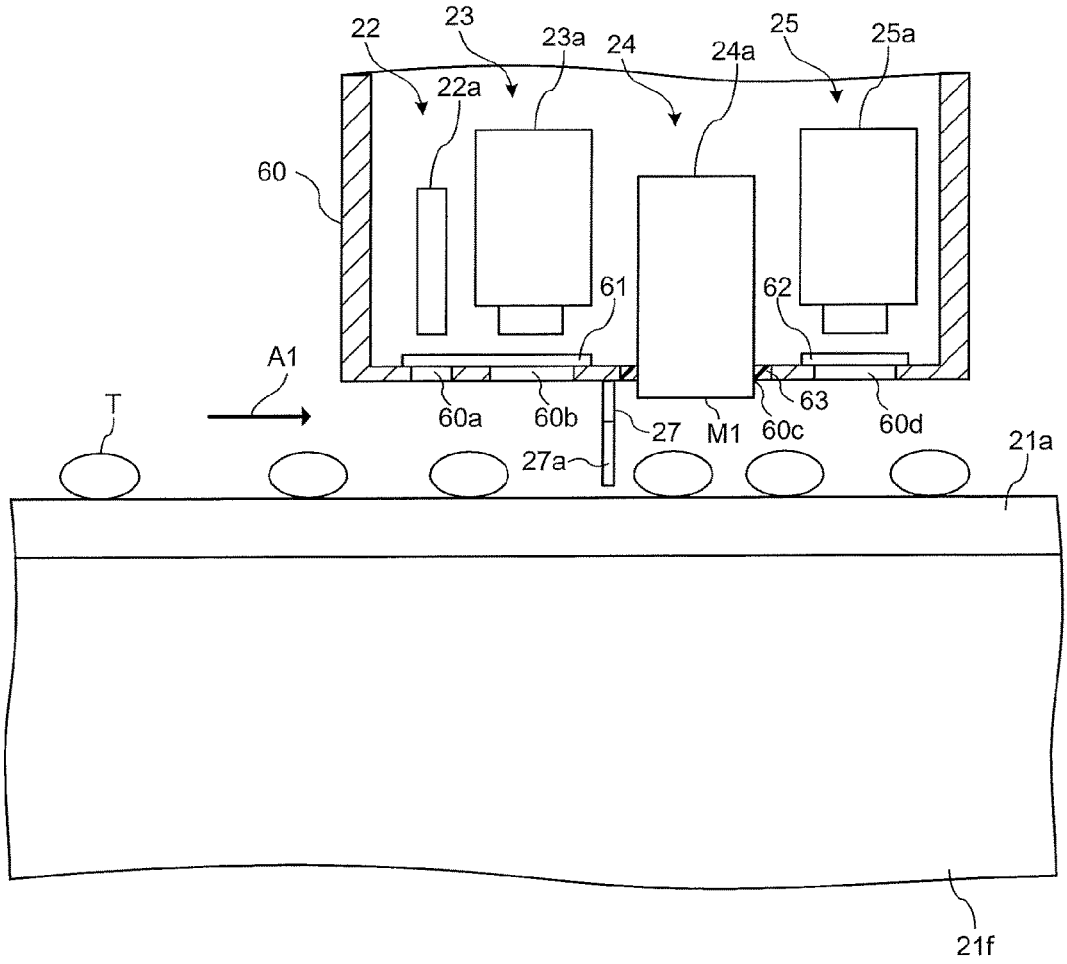
FIG. 6 is a diagram illustrating a part of a first printing device according to a second embodiment.

As illustrated in FIG. 6, in the second embodiment, there is provided the cover 60. The cover is a housing configured to house the detecting device 22 (the two detectors 22*a*), the first imaging device 23 (the two imaging units 23*a*), the print head device 24 (the two print heads 24*a*), and the second imaging device 25 (the two imaging units 25*a*). The cover 60 is arranged above the conveyor belt 21*a* at a predetermined distance (for example, 5 mm to 12 mm) from the upper surface of the conveyor belt 21*a* according to the thickness of the tablet T (for example, 2 mm to 4 mm) such that the lower surface of the cover 60 does not contact the tablet T conveyed by the conveyor belt 21*a*.

On the lower surface of the cover 60, two through holes 60*a* are formed in a direction perpendicular to the conveying direction A1 in the horizontal plane so that each of the detectors 22*a* in the cover 60 can detect the tablet T on the conveyor belt 21*a*. Besides, two through holes 60*b* are formed in the same direction as the alignment of the through holes 60*a* so that each of the imaging units 23*a* in the cover 60 can capture an image of the tablet T on the conveyor belt 21*a*. Further, on the lower surface of the cover 60, two through holes 60*c* are formed in the same direction as the alignment of the through holes 60*a* so that each of the print heads 24*a* in the cover can perform printing on the tablet T on the conveyor belt 21*a*. In addition, two through holes 60*d* are formed in the same direction as the alignment of the through holes 60*a* so that each of the imaging units 25*a* in the cover 60 can capture an image of the tablet T on the conveyor belt 21*a*.

Each of the through holes 60*a*, 60*b*, and 60*d* is covered with transparent members 61 and 62 such as glass provided to the bottom surface of the inside of the cover 60. The print head 24*a* is inserted into each of the through holes 60*c* via a sealing member 63 such as silicon to close the through holes 60*c*. In this manner, the cover 60 is formed to be sealed, and the inside of the cover 60 is maintained at a positive pressure.

On the lower surface of the cover 60, the control plate 27 is arranged between the imaging units 23*a* and the print heads 24*a* (at least on the upstream side of the print heads 24*a* in the conveying direction A1 of the tablets T). As in the first embodiment, the control plate 27 enables the control of the airflow generated between the conveyor belt 21*a* and each of the print heads 24*a*. Thus, a reduction in print quality due to the powder of the tablets T can be suppressed.

Further, according to the second embodiment, when the operation of the tablet printing apparatus 1 is stopped and the entire apparatus is cleaned, by removing the cover 60, the control plate 27 attached to the cover 60 can also be detached. Thereby, the cover 60 and the control plate 27 can be cleaned at once. Thus, the cleaning can be performed efficiently. On the other hand, the detecting device 22, the first imaging device 23, and the second imaging device 25 are covered with the cover 60. Therefore, powder does not adhere to these devices, and there is no need to clean them. Thus, the cleaning can be simplified.

<Third Embodiment>

Next, a third embodiment will be described with reference to FIGS. 7 and 8. In the third embodiment, differences from the second embodiment (gas blower and gas suction unit) will be described. Other explanation will be omitted.

Figure 7:
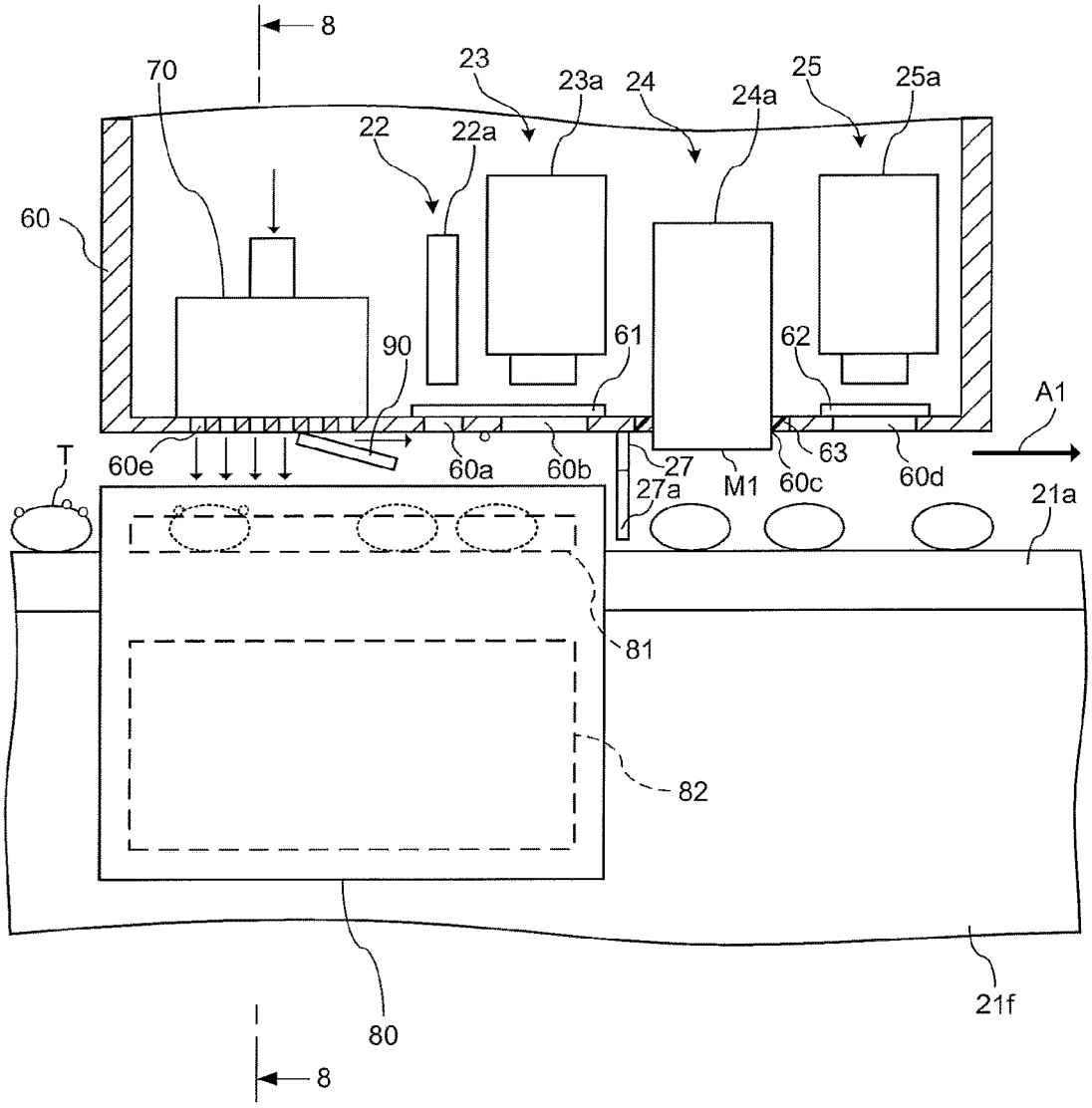
FIG. 7 is a diagram illustrating a part of a first printing device according to a third embodiment.
Figure 8:
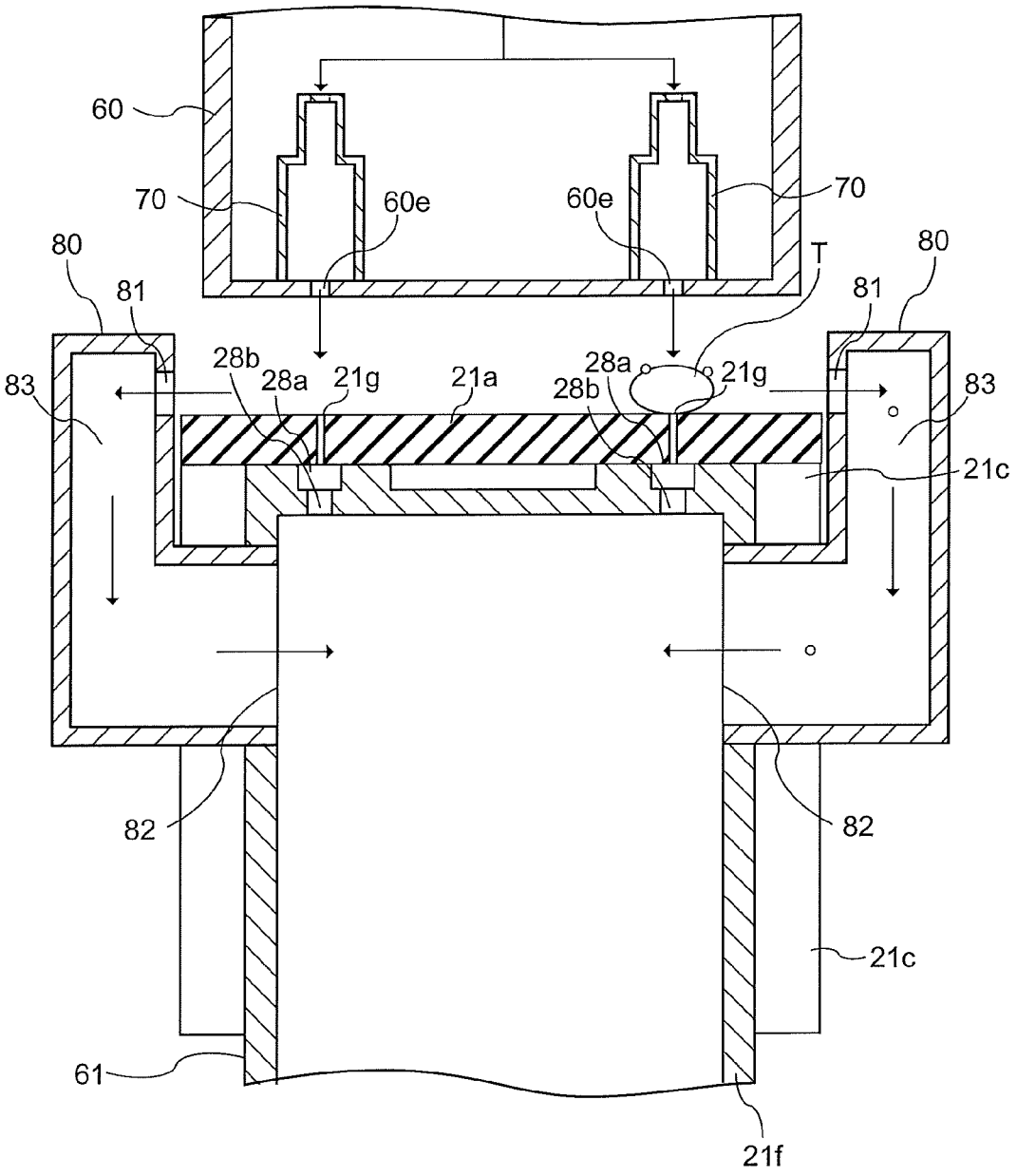
FIG. 8 is a cross-sectional view taken along the line 8-8 in FIG. 7.

As illustrated in FIGS. 7 and 8, in the third embodiment, in addition to the cover 60, there are provided two gas blowers 70 and two gas suction units 80. Each of the gas blowers 70 and each of the gas suction units 80 function as a deposit removing mechanism. The deposit removing mechanism blows a gas (for example, air or inert gas) against deposits (for example, powder and dust) adhering to the tablet T on the conveyor belt 21*a* or the lower surface of the cover 60 to blow off the deposits from the tablet T or the lower surface of the cover 60. The blown off deposits are sucked together with air, and thus removed from the tablet T or the lower surface of the cover 60. Also, as the tablets T are conveyed by the conveyor belt 21*a*, the powder of the tablets T may sometimes fly in the apparatus. The gas blowers 70 and the gas suction units 80 also remove the powder flying in the apparatus, in particular the powder flying around the cover 60.

In addition to the detecting device 22, the first imaging device 23, the print head device 24, and the second imaging device 25, the cover 60 is a housing that houses the two gas blowers 70. As in the second embodiment, the cover 60 is arranged above the conveyor belt 21*a* at a predetermined distance from the upper surface of the conveyor belt 21*a* according to the thickness of the tablet T such that the lower surface thereof does not contact the tablet T conveyed by the conveyor belt 21*a*. On the lower surface of the cover 60, as in the second embodiment, the control plate 27 is arranged between the imaging units 23*a* and the print head 24*a*. The control plate 27 enables the control of the airflow generated between the conveyor belt 21*a* and each of the print heads 24*a*. Thus, a reduction in print quality due to the powder of the tablets T can be suppressed.

A plurality of through holes 60*e* are formed in the lower surface of the cover 60 so that each of the gas blowers 70 in the cover 60 can blow gas against the upper surface of the conveyor belt 21*a*. The through holes 60*e* are formed, for example, in an array in the conveying direction A1 with respect to each of the gas blowers 70. The gas blown out from the gas blowers 70 passes through the through holes 60*e* that penetrate the lower surface of the cover 60, and is blown onto the conveyor belt 21*a*. For example, the diameter of the through holes 60*e* is a few mm (for example, about 2 mm). Each of the through holes 60*e* is covered with each of the gas blowers 70 arranged on the bottom surface of the inside of the cover 60. In this manner, the cover 60 is formed to be sealed, and the inside of the cover 60 is maintained at a positive pressure.

The gas blowers 70 are each connected to each of the through holes 60*e* in the lower surface of the cover 60, and blow gas from the through holes 60*e* against the conveyor belt 21*a*. As a result, when the tablets T on the conveyor belt 21*a* pass under the gas blowers 70, the gas is blown against the tablets T on the conveyor belt 21*a*, and the deposits adhering to the upper surface of the conveyor belt 21*a* and the tablets T are blown away from tablets T. Each of the gas blowers 70 is connected to a gas supply unit via a flow regulating valve (not illustrated), and gas is supplied from the gas supply unit to each of the gas blowers 70.

Further, on the lower surface of the cover 60, guide plates 90 are provided for each of the gas blowers 70 and located on the downstream side in the conveying direction A1 below the gas blowers 70. The guide plates 90 are formed in a rectangular shape, the longitudinal direction of which is parallel to a direction perpendicular to the conveying direction A1 in the horizontal plane, and are tilted down to the print head device 24 side. The guide plate 90 flows a part of the gas blown out from the gas blowers 70 through each of the through holes 60*e* toward the downstream side in the conveying direction A1 to generate an airflow flowing in the conveying direction A1 along the lower surface of the cover 60. With this, gas is blown to deposits adhering to the lower surface of the cover 60, and the deposits are blown away from the lower surface of the cover 60. Although the guide plates 90 are described as being provided one for each of the gas blowers 70 arranged in two rows, it is not so limited. One guide plate 90 may be shared as a common member.

The gas suction units 80 are each arranged adjacent to the side surface of the conveyor belt 21*a* such that the conveyor belt 21*a* is located between them, and are attached to the suction chamber 21*f*. The gas suction units 80 each include an inlet port 81, an outlet port 82, and an internal flow path 83 (see FIG. 8).

The inlet port 81 and the outlet port 82 are formed in a rectangular shape (slit shape) extending in the conveying direction A1. The inlet port 81 is an opening for sucking air from the space between the upper surface of the conveyor belt 21*a* and the lower surface of the cover 60. The inlet port 81 is located on the conveyor belt 21*a* side in the gas suction unit 80 at a position higher than the upper surface of the conveyor belt 21*a*. The opening of the inlet port 81 is provided such that the terminal end thereof is located upstream of the control plate 27 in the conveying direction A1. Thereby, gas from the gas blowers 70 does not flow to each of the print heads 24*a*. Thus, the nozzles 24*b* of each of the print heads 24*a* are prevented from drying and causing ejection failure, and the ink ejected from the nozzles 24*b* is prevented from being influenced by the airflow and resulting in the ejection direction disorder. The outlet port 82 is located on the conveyor belt 21*a* side in the gas suction unit 80 at a position lower than the conveyor belt 21*a*, and is connected to the inside of the suction chamber 21*f*. The internal flow path 83 is formed inside the gas suction unit 80 and is a flow path that connects the inlet port 81 and the outlet port 82.

When the inside of the suction chamber 21*f* is sucked for conveying the tablet T, air is sucked from the outlet port 82 in each of the gas suction units 80. Then, air in the space between the upper surface of the conveyor belt 21*a* and the lower surface of the cover 60 is sucked from the inlet port 81 via the internal flow path 83 connected to the outlet port 82. As a result, deposits blown off by the gas from the gas blowers 70 are sucked together with the air from the inlet port 81.

The suction force of the gas suction unit 80 can be adjusted by changing the length of the inlet port in the height direction. However, it is desirable that the length of the inlet port 81 in the height direction be shorter than the height of the tablet T. Normally, the suction force for sucking air from the inlet port 81 is not set to the one by which the tablet T is sucked through the inlet port 81. However, if the adjustment of the suction force is insufficient or the type of the tablets T is changed (the tablets T having different sizes), there is a concern that the tablets T may be sucked through the inlet port 81. Therefore, by making the length of the inlet port 81 in the height direction shorter than the height of the tablet T, the tablet T can be prevented from being sucked through the inlet port 81. The longitudinal length of the inlet port 81 is appropriately set based on the suction range required to remove deposits adhering to the tablets T on the conveyor belt 21*a*.

Further, the amount of gas from the gas blowers 70 and the suction force of air from the inlet port 81 are set such that the position of the tablet T (including the position of the tablet T in the X direction, the Y direction, and the θ direction, the posture such as the inclination of the tablet T, etc.) does not change on the conveyor belt 21*a* and the tablet T does not fall from the conveyor belt 21*a* due to the gas from the gas blowers 70 and the suction force by which the air is sucked from the inlet port 81.

Blowing of gas from the gas blowers 70 and suction of air from the gas suction units 80 are always performed during the operation of the tablet printing apparatus 1. Even if the tablet T does not arrive at the gas blowers 70, the detecting device 22, the first imaging device 23, or the print head device 24 for a certain period of time, gas is blown from the gas blowers 70 and air is sucked from the gas suction units 80. Thereby, powder adhering to the conveyor belt 21*a* can be removed, and powder is prevented from adhering to the conveyor belt 21*a*. If a large amount of powder of the tablets T adheres to the conveyor belt 21*a* or the transparent member 61, the first imaging device 23 may photograph a portion where the powder accumulates. This may result in that erroneous detection takes place irrespective of the fact that there is no tablet T, and printing is carried out on the conveyor belt 21*a*. However, by constantly blowing gas from the gas blowers 70 and sucking air from the gas suction units 80, such erroneous detection can be prevented.

Besides, when tablets T are newly supplied in a state where powder is adhered onto the conveyor belt 21*a*, the tablets T slide on the conveyor belt 21*a* and fall from the conveyor belt 21*a*, or the posture of the tablets T changes on the conveyor belt 21*a*. Sliding of the tablets T on the conveyor belt 21*a* at the time of restarting the conveyance of the tablets T can also be suppressed by constantly blowing and sucking gas by the deposit removing mechanism during the operation of the tablet printing apparatus 1.

In the configuration as described above, when printing is performed on the tablets T, gas is blown out from each of the through holes 60*e* onto the conveyor belt 21*a* by each of the gas blowers 70. Further, the air in the suction chamber 21*f* is sucked, and accordingly, the air in the space between the upper surface of the conveyor belt 21*a* and the lower surface of the cover 60 is sucked from the individual inlet ports 81 of the gas suction units 80. In this state, gas is blown by the gas blowers 70 when the tablets T being conveyed by the conveyor belt 21*a* pass under the gas blowers 70. At this time, when deposits adhere to the tablets T, the deposits are blown away from the tablets T and sucked by the gas suction units 80 together with the air. In this manner, the deposits adhering to the tablets T are removed. Thus, it is possible to prevent printing on the tablets T to which deposits adhere, and a reduction in print quality can be suppressed.

In addition, the gas is blown onto the conveyor belt 21*a* by the gas blowers 70, a part of the gas is guided by the guide plate 90 to flow along the lower surface of the cover 60 in the conveying direction A1. As a result, the gas is blown against deposits adhering to the lower surface of the cover 60, and the deposits are blown away from the lower surface of the cover 60. The deposits are sucked by the gas suction units 80 together with the air. In this manner, the deposits adhered to the lower surface of the cover 60, that is, the transparent members 61 and 62, are removed. Thus, erroneous detection and recognition can be suppressed, and a reduction in print quality can be suppressed. Further, since the powder of the tablets T flying around the cover 60 can also be sucked and removed, the powder of the tablets T can be suppressed from adhering to the tablet T, the lower surface of the cover 60, the conveyor belt 21*a*, and the like. The longitudinal length of the guide plate 90, the length along the conveying direction A1, and the inclination angle are each set to a value that can blow off deposits adhering to the transparent members 61 and 62 so as not to contact the tablets T conveyed thereunder. The guide plate 90 is not limited to a flat plate and it may be a plate having a curved shape as long as deposits adhering to the transparent members 61 and 62 can be blown off.

As described above, a part of the gas flows along the lower surface of the cover 60 by the guide plate 90. The gas flowing along the lower surface of the cover 60 in the conveying direction A1 hits the control plate 27, and the part of the gas is sucked from the inlet port 81 of the gas suction unit 80. At this time, the deposits blown off from the lower surface of the cover 60 are also sucked through the inlet port 81 together with the gas. This prevents the airflow flowing along the lower surface of the cover 60 and the deposits blown off from the lower surface of the cover 60 from adversely affecting the printing of each of the print heads 24*a*. Thus, a reduction in print quality can be suppressed.

Incidentally, the conveyor belt 21*a* described above may sometimes vibrate when the tablet T is conveyed. At this time, deposits (for example, powder and dust) adhering to the conveyor belt 21*a* tend to fly up due to the swinging of the conveyor belt 21*a*. However, the flying is suppressed by the gas blown from the gas blowers 70. Even if the deposits fly up, the deposits are sucked by the gas suction units 80. Thereby, the deposits adhering to the conveyor belt 21*a* are prevented from adhering to the tablets T on the conveyor belt 21*a*. Thus, a reduction in print quality can be suppressed.

Further, in order to suppress the flying of powder caused by the above-mentioned airflow, the suction force of the suction hole 21*g*, that is, the suction force for sucking the tablets T, can be reduced in the whole or a part of the conveyor belt 21*a* (for example, in a predetermined area including an area below the print heads 24*a*) However, when the suction force for sucking the tablets T is weakened, the conveyor belt 21*a* may vibrate in the portion where the suction force is lowered. At this time, even if the deposit adhering to the conveyor belt 21*a* tend to fly up due to the swinging of the conveyor belt 21*a*, the flying is suppressed by the gas blown from the gas blowers 70. Even if the deposits fly up, the deposits are sucked by the gas suction units 80. Thereby, the deposits adhering to the conveyor belt 21*a* are prevented from adhering to the tablets T on the conveyor belt 21*a*. Thus, a reduction in print quality can be suppressed.

(Modification of the Cover)

In the above example, the through holes 60*e* of the cover 60 are described as being formed so as to line up in the conveying direction A1; however, it is not so limited. The through holes 60*e* may be arranged in two or more rows, or they need not necessarily be formed in rows and may be randomly formed. Further, the through holes 60*e* may be formed in a slit shape.

In the above example, the detecting device 22, the first imaging device 23, the print head device 24, and the second imaging device 25 are described as being housed in the cover 60; however, it is not so limited. Because of the cover 60, powder does not adhere to the detecting device 22, the first imaging device 23, the print head device 24, and the second imaging device 25, and only the cover 60 can be detached and cleaned. Therefore, it is efficient when the type of tablets T is changed. However, if the deposit removing mechanism functions sufficiently, the cover 60 may be eliminated. At this time, the guide plate 90 is attached to the gas blowers 70. By eliminating the cover 60 as described above, it is possible to freely change the height position of each of the detecting device 22, the first imaging device 23, the print head device 24, and the second imaging device 25.

(First Modification and Second Modification of the Gas Suction Unit)

In the above example, the inlet port 81 of the gas suction unit 80 is described as being formed in a rectangular shape extending in the conveying direction A1; however, it is not so limited. For example, the inlet port 81 may be formed in a triangular shape (first modification) that gradually narrows along the conveying direction A1. Alternatively, a plurality of rectangular inlet ports 81 having different elongated lengths may be arranged in the height direction with individual left ends aligned (second modification). In these cases, the suction force in the gas suction unit 80 gradually weakens along the conveying direction A1, that is, gradually decreases toward the print head device 24 side (right side in FIG. 7). Therefore, an airflow generated by the suction of the gas suction unit 80 can be prevented from adversely affecting the printing of the print head device 24. Thus, a reduction in print quality can be more reliably suppressed. Incidentally, the gas from the gas blowers is not supplied directly but is supplied via the guide plate 90 around the inlet ports 81 on the downstream side of the gas suction units 80 in the conveying direction A1. Therefore, there is no problem even if the amount of air sucked through the inlet port 81 decreases. It is also possible to arrange the circular or elliptical inlet ports 81 having different sizes in one row or a plurality of rows along the conveying direction A1.

(Third Modification of the Gas Suction Unit)

In the above example, the suction force of the gas suction unit 80 is described adjustable by changing the length of the inlet port 81 of the gas suction unit 80 in the height direction; however, it is not so limited. For example, a suction force adjusting member (not illustrated) may be provided in the internal flow path 83 of the gas suction unit 80. The suction force adjusting member has a rectangular (slit-like) through hole extending in the conveying direction A1, and is provided in the inside of the internal flow path 83 so as to close it to adjust the suction force by changing the flow amount of the gas passing through the internal flow path 83. The suction force of the gas suction unit 80 can be easily adjusted by preparing several types of suction force adjusting members having different slit widths of the through holes (widths in a direction perpendicular to the conveying direction A1 in the horizontal plane in the through holes) and selecting one of them for use depending on the required suction force.

Although the through hole of the suction force adjusting member is formed in a rectangular shape extending in the conveying direction A1, it is not so limited. The through hole may be formed in various shapes such as a circular shape, an elliptical shape, a triangular shape, or the like. Besides, the number of the through holes is also not limited, and there may be a plurality of through holes. For example, a plurality of through holes having a circular shape, an elliptical shape, and the like may be formed to be aligned in the conveying direction A1, or may be formed to be aligned in a plurality of rows (for example, two rows or three rows). The through holes may also be formed irregularly (randomly).

The suction force adjusting member forming the through hole may be detachable so that it can be replaced when the type of the tablet T to be printed is changed. In this manner, even if the object to be printed is changed, the suction force can be easily adjusted. The suction force adjusting member may be attached anywhere within the gas suction unit 80, and may be attached to the inlet port 81 or may be attached to the outlet port 82.

In the above example, the gas suction units 80 are described as being provided only on the upstream side of the print head 24*a* in the conveying direction A1; however, it is not so limited. The gas suction units 80 may be provided in other places. The gas suction units 80 may be provided on the entire circumference of the conveyor belt 21*a* or a part thereof. Providing a plurality of the gas suction units 80 increases the opportunity to suck powder adhering to the conveyor belt 21*a*. Thus, it is possible to suppress a reduction in print quality due to the adhesion of powder to the print head 24*a* or the position shift of the tablet T during conveyance. Particularly, in the case where the gas suction unit 80 is provided in the portion where the centrifugal force is applied (the pulley body 21*b* portion, the driven pulleys 21*c* portion), powder adhering to the conveyor belt 21*a* is liable to float due to the centrifugal force. Accordingly, the powder can be sucked efficiently by the gas suction unit 80. Further, since the suction hole 21*g* of the conveyor belt 21*a* in the driven pulley 21*c* portion is not connected to the suction chamber 21*f*, the powder is not sucked through the suction hole 21*g*. Therefore, it is particularly effective to provide the gas suction unit 80 in this portion.

<Fourth Embodiment>

Next, a fourth embodiment will be described with reference to FIG. 9. In the fourth embodiment, differences (the configuration of the control plate) from the first embodiment will be described, and other explanation will be omitted.

Figure 9:
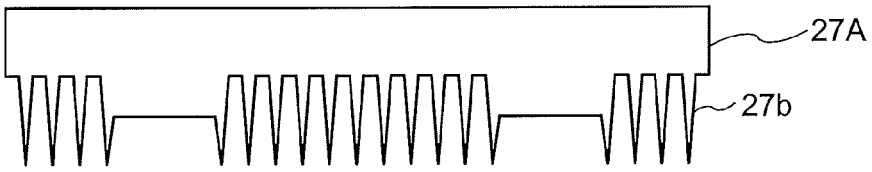
FIG. 9 is a diagram illustrating a control plate according to a fourth embodiment.

As illustrated in FIG. 9, an end portion of the conveyor belt 21*a* side in a control plate 27A of the fourth embodiment is formed like saw so that a plurality of comb teeth 27*b* are aligned in the longitudinal direction (a direction perpendicular to the conveying direction A1 in the horizontal plane). Each of the comb teeth 27*b* is formed to gradually become narrower toward the lower side (that is, the upper surface of the conveyor belt 21*a*). With the control plate 27A, as in the above embodiments, it is possible to control the airflow generated between the conveyor belt 21*a* and each of the print heads 24*a*. Thus, a reduction in print quality due to the powder of the tablets T can be suppressed.

In addition to making the entire comb teeth 27*b* gradually narrower as described above, only the tip of the comb teeth 27*b* may be narrowed. In addition to making the comb teeth 27*b* gradually narrowed downward, the comb teeth 27*b* may be made to become gradually thick downward. Alternatively, the central portion of the comb teeth 27*b* may be thickened.

<Fifth Embodiment>

Next, a fifth embodiment will be described with reference to FIGS. 10 and 11. In the fifth embodiment, differences (the configuration of the control plate) from the first embodiment will be described, and other explanation will be omitted.

Figure 10:
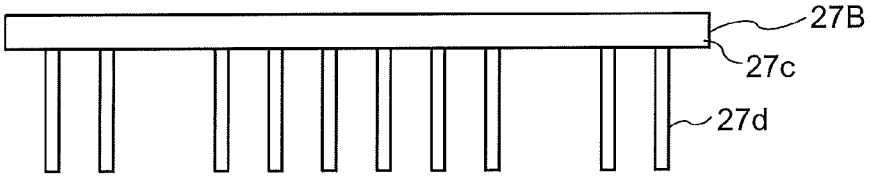
FIG. 10 is a diagram illustrating a control plate according to a fifth embodiment.
Figure 11:
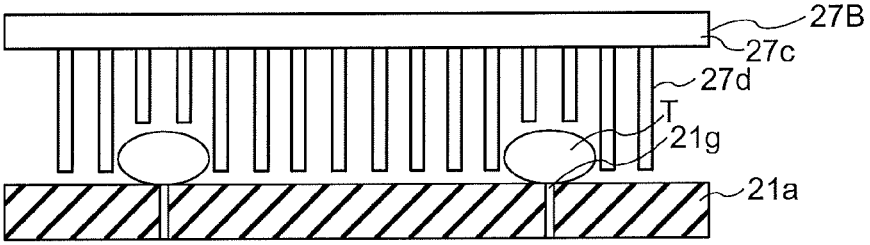
FIG. 11 is a diagram illustrating a modification of the control plate of the fifth embodiment.

As illustrated in FIG. 10, a control plate 27B of the fifth embodiment includes a support unit 27*c* and a plurality of comb teeth 27*d*. The support unit 27*c* is formed in a rectangular plate shape. The comb teeth 27*d* are provided at the lower end of the support unit 27*c* so as to be aligned in the longitudinal direction of the support unit 27*c* (a direction perpendicular to the conveying direction A1 in the horizontal plane). With the control plate 27B, as in the above embodiments, it is possible to control the airflow generated between the conveyor belt 21*a* and each of the print heads 24*a*. Thus, a reduction in print quality due to the powder of the tablets T can be suppressed.

Besides, the airflow flowing above the conveyor belt 21*a* along the conveying direction A1 hits the control plate 27B and passes through the opening portion where the airflow passes (space between the comb teeth 27*d*) in the control plate 27B. With the control plate 27B, as in the above embodiments, the airflow flowing above the conveyor belt 21*a* can be rectified into a laminar flow along the conveying direction A1. Further, it is possible to rectify the airflow on the conveyor belt 21*a* below and around the print head 24*a* into a laminar flow, thereby suppressing the occurrence of turbulence. With this, the shaking of the tablet T sucked and held by the conveyor belt 21*a* can be suppressed. Thus, it is possible to suppress a reduction in print quality due to the inability to maintain the posture of the print surface of the tablet T when the tablet T passes under the print head 24*a*.

Incidentally, the support unit 27*c* need not necessarily be in a rectangular plate shape, and it may be formed in another plate shape or a rod shape. The comb teeth 27*d* may be gradually narrowed downward, or it may be made gradually thicker downward. Alternatively, only the tip of the comb teeth 27*d* may be narrowed, or the central portion of the comb teeth 27*d* may be thickened. Further, as illustrated in FIG. 11, the comb teeth 27*d* may be provided at above a position where the tablet T passes so as not to contact the tablet T (at a height where the comb teeth 27*d* do not contact the tablets T). In the example of FIG. 11, the two comb teeth 27*a* that sandwich the tablet T conveyed by the conveyor belt 21*a* correspond to the "two adjacent comb teeth 27*a*", and the horizontal distance between them is larger than the diameter of the tablet T to be printed (an example of the maximum size of the tablet T in the horizontal direction) according to the diameter of the tablet T.

<Sixth Embodiment>

Next, a sixth embodiment will be described with reference to FIG. 12. In the sixth embodiment, differences (the configuration of the control plate) from the first embodiment will be described, and the other explanation will be omitted.

Figure 12:
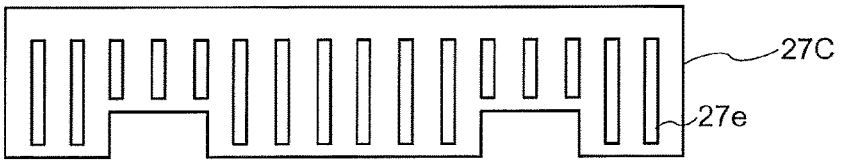
FIG. 12 is a diagram illustrating a control plate according to a sixth embodiment.

As illustrated in FIG. 12, in a control plate 27C of the sixth embodiment, a plurality of rectangular through holes 27*e* are formed in a row in the longitudinal direction (a direction perpendicular to the conveying direction A1 in the horizontal plane). With the control plate 27C, as in the above embodiments, it is possible to control the airflow generated between the conveyor belt 21*a* and each of the print heads 24*a*. Thus, a reduction in print quality due to the powder of the tablets T can be suppressed.

Besides, the airflow flowing above the conveyor belt 21*a* along the conveying direction A1 hits the control plate 27C and passes through the opening portion where the airflow passes (the through holes 27*e*) in the control plate 27C. With the control plate 27C, as in the above embodiments, the airflow flowing above the conveyor belt 21*a* can be rectified into a laminar flow along the conveying direction A1. With this, the shaking of the tablet T sucked and held by the conveyor belt 21*a* can be suppressed. Thus, it is possible to suppress a reduction in print quality due to the inability to maintain the posture of the print surface of the tablet T when the tablet T passes under the print head 24*a*.

Incidentally, the through holes 27*e* need not necessarily be in a rectangular shape, and they may have, for example, an elliptical shape or a triangular shape. Further, the through holes 27*e* need not necessarily be arranged at regular intervals, and may be arranged at irregular intervals. For example, there may be no through hole 27*e* above the position where tablet T passes. Alternatively, the opening area of the through hole 27*e* above the position where tablet T passes may be made smaller or larger than that of the through holes 27*e* provided in other places.

<Seventh Embodiment>

Next, a seventh embodiment will be described with reference to FIG. 13. In the seventh embodiment, differences (the configuration of the control plate) from the first embodiment will be described, and other explanation will be omitted.

Figure 13:
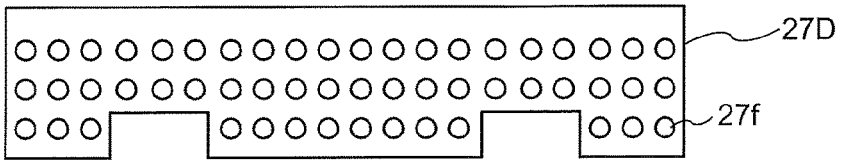
FIG. 13 is a diagram illustrating a control plate according to a seventh embodiment.

As illustrated in FIG. 13, in a control plate 27D of the seventh embodiment, a plurality of circular through holes 27*f* are formed to be aligned at a predetermined interval in the longitudinal direction of a rectangle (a direction perpendicular to the conveying direction A1 in the horizontal plane) and in the short side direction. As the control plate 27D, for example, a punching board or a mesh plate can be used. With the control plate 27D, as in the above embodiments, it is possible to control the airflow generated between the conveyor belt 21*a* and each of the print heads 24*a*. Thus, a reduction in print quality due to the powder of the tablets T can be suppressed.

Besides, the airflow flowing above the conveyor belt 21*a* along the conveying direction A1 hits the control plate 27D and passes through the opening portion where the airflow passes (the through holes 27*f*) in the control plate 27D. With the control plate 27D, as in the above embodiments, the airflow flowing above the conveyor belt 21*a* can be rectified into a laminar flow along the conveying direction A1. With this, the shaking of the tablet T sucked and held by the conveyor belt 21*a* can be suppressed. Thus, it is possible to suppress a reduction in print quality due to the inability to maintain the posture of the print surface of the tablet T when the tablet T passes under the print head 24*a*.

Incidentally, the through holes 27*f* need not necessarily be in a circular shape, and they may have, for example, a quadrilateral shape, an elliptical shape, or a triangular shape. In addition, the through holes 27*f* need not necessarily be arranged at regular intervals, and may be arranged at irregular intervals.

It is also possible to combine the embodiments illustrated in FIGS. 4, 9, 10, 11, 12 and 13. In each embodiment, the size and shape of the comb teeth 27*a*, 27*b* or 27*d*, or the size and shape of the through holes 27*e* or 27*f* are appropriately selected according to the size and shape of the tablet T. The airflow generated varies depending on the type of the tablet T. Therefore, the size and shape of the comb teeth 27*a*, 27*b* or 27*d*, or the size and shape of the through holes 27*e* or 27*f* are appropriately selected to control the direction of the airflow around the conveyor belt 21*a* and the print heads 24*a*, the distribution of the flow rate, and the like according to the size and shape of the comb teeth 27*a*, 27*b* or 27*d*, or the size and shape of the through holes 27*e* or 27*f*.

The "blocking portion in which the airflow is blocked" in the control plates 27, 27A and 27B corresponds to the plurality of comb teeth 27*a*, 27*b* and 27*d*. The "opening portion where the airflow passes" is a space between the teeth of the plurality of the comb teeth 27*a*, 27*b* and 27*d*. In addition, the "blocking portion in which the airflow is blocked" in the control plates 27C and 27D corresponds to a portion other than the plurality of through holes 27*e* and 27*f*. Besides, the "opening portion where the airflow passes" corresponds to the through holes 27*e* and 27*f*.

The control plate 27, 27A or 27B according to any one of the first to fifth embodiments is formed in a comb shape. Therefore, when the interior of the apparatus is cleaned to change the type of the tablet T to be printed, the control plate 27, 27A or 27B can be easily cleaned and kept clean as compared to the control plate 27C or 27D according to the sixth or seventh embodiment.

As described above, the control plate 27, 27A or 27B is formed in a comb shape. Therefore, by letting the airflow flowing above the conveyor belt 21*a* pass between the teeth of the plurality of comb teeth 27*a,* 27*b* or 27*d,* the airflow is rectified to an airflow along each of the comb teeth, and can be more easily rectified into a laminar flow flowing along the conveying direction A1. Thereby, as described above, it is possible to perform printing as well as suppressing the occurrence of turbulence that may shake the tablet T sucked and held on the surface of the conveyor belt 21*a*.

In addition, the control plate 27, 27A or 27B is formed in a comb teeth shape and arranged so as to open toward the upper surface of the conveyor belt 21*a*. That is, although the lower end portion of the control plate 27, 27A or 27B is open, if the lower end portion of the control plate 27, 27A or 27B is not open, the gap between the conveyor belt 21*a* and the lower end portion of the control plate 27, 27A or 27B becomes narrower. Accordingly, it is presumable that the flow rate of the airflow passing through this gap increases, resulting in the further generation of turbulence. However, if the control plate 27, 27A or 27B is formed in a comb teeth shape, it is possible to reduce the portion which blocks the airflow around the conveyor belt 21*a*. Accordingly, the flow rate increases near the conveyor belt 21*a,* and further turbulence does not occur on the surface of the conveyor belt 21*a* below the print head 24*a*. Thus, printing can be performed while the shaking of the tablet T sucked and held can be suppressed.

<Other Embodiments>

In the above embodiments, an example is described in which the tablets T are conveyed in two rows; however, it is not so limited. The number of rows is not particularly limited, and there may be one row, three rows, or four or more rows.

In the above embodiments, there is provided only one conveyor belt 21*a;* however, it is not so limited. The number of conveyor belt is not particularly limited, and there may be two or more conveyor belts. For example, a plurality of conveyor belts 21*a* may be arranged in parallel.

In the above embodiments, the suction holes 21*g* of the conveyor belt 21*a* is described as being circular; however, it is not so limited. The shape of the suction holes 21*g* of the conveyor belt 21*a* is not particularly limited, and the suction holes may be in a rectangular shape, an elliptical shape, or a slit-like shape.

In the above embodiments, the print head 24*a* is described as being provided for each conveying path of the tablet T; however, it is not so limited. For example, printing on two or more rows of tablets T may be performed by one print head 24*a*.

In the above embodiments, a print head in which the nozzles 24*b* are arranged in a row is exemplified as the ink jet print head 24*a;* however, it is not so limited. For example, a print head in which the nozzles 24*b* are arranged in a plurality of rows may be used. Further, a plurality of print heads 24*a* may be arranged side by side along the conveying direction A1 of the tablets T.

In the above embodiments, an example is described in which the first printing device 20 and the second printing device 30 are placed one on top of the other to perform printing on both sides or one side of the tablet T; however, it is not so limited. For example, only the first printing device may be provided to perform printing only on one side of the tablet T.

In the above embodiments, the gas blower 42*a* is described as being provided to the non-defective product collecting unit 42; however, it is not so limited. For example, the gas blower 42*a* may be provided to the end portion of the conveying device 31 side in the conveying device 21 or a place where the tablets T is transferred from the transfer feeder 13 to the conveying device 21. In other words, the gas blower 42*a* may be used at a place where the tablet T is desired to be taken off from the conveyor belt 21*a*.

In the above embodiments, the gas blower 42*a* is described as always blowing out gas during the process; however, it is not so limited. The gas blower 42*a* may blow out gas intermittently.

In the above embodiments, the control plates 27 and 37 are described as being flat plates; however, it is not so limited. For example, the control plates 27 and 37 may be curved plates.

In the above embodiments, the control plate 27 is described as being arranged to be perpendicular to the lower surface (nozzle surface M1) of each of the print heads 24*a;* however, it is not so limited. For example, the control plate 27 may be inclined with respect to the conveying direction A1.

In the second embodiment, the control plate 27 is described as being arranged between the imaging unit 23*a* and the print head 24*a* on the lower surface of the cover 60; however, it is not so limited. The control plate 27 may be arranged at the tip of the cover 60 on the upstream side in the conveying direction A1 (upstream side in the tablet conveying direction).

In the third embodiment, the guide plate 90 is described as being in a rectangular shape; however, the guide plate 90 may have a shape provided with comb teeth or through holes, that is, a shape having an opening portion and a blocking portion. In this case, it is possible to rectify the gas ejected from the gas blowers 70, and deposits can be prevented from adhering again by the rectified airflow. In addition, it is also possible to suppress the generation of new turbulence caused by the ejection of the gas from the gas blowers 70. Note that if the guide plate 90 in FIG. 7 is in a shape having an opening portion and a blocking portion, the control plate 27 can be eliminated.

The above-described tablets may include tablets for pharmaceutical use, edible use, cleaning, industrial use, and aromatic use. Examples of the tablet include a plain tablet (uncoated tablet), a sugar-coated tablet, a film-coated tablet, an enteric coated tablet, a gelatin coated tablet, a multilayered tablet, a dry-coated tablet, and the like. Examples of the tablet further include various capsule tablets such as hard capsules and soft capsules. The tablets may be in a variety of shapes such as, for example, a disk shape, a lens shape, a triangle shape, an oval shape, and the like. In the case where tablets to be printed are for pharmaceutical use and edible use, edible ink is suitably used. As the edible ink, any of synthetic dye ink, natural color ink, dye ink, and pigment ink may be used.

While certain embodiments have been described, these embodiments have been presented by way of example only, and are not intended to limit the scope of the inventions. Indeed, the novel embodiments described herein may be embodied in a variety of other forms; further, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tablet printing apparatus, comprising:

a conveyor belt including a suction hole connected to a suction chamber, and configured to convey a tablet while sucking the tablet to the suction hole;

an ink jet print head including a nozzle surface where a nozzle is formed, located above the conveyor belt such that the nozzle surface faces the conveyor belt, and configured to perform printing on the tablet conveyed by the conveyor belt; and a control plate located on an upstream side of the print head in a conveying direction of the tablet between the conveyor belt and a height position of the nozzle surface of the print head, and configured to control an airflow generated between the conveyor belt and the print head, wherein the control plate is arranged such that a longitudinal direction of the control plate is perpendicular to the conveying direction of the tablet in a horizontal plane, and the control plate includes a blocking portion configured to block an airflow generated between the conveyor belt and the print head and flowing along the conveying direction of the tablet, and an opening portion through which the airflow passes.

2. The tablet printing apparatus according to claim 1, wherein a plurality of comb teeth is formed in an end portion of the control plate on conveyor belt side so as to be aligned along a direction crossing the conveying direction of the tablet in a horizontal plane.

3. The tablet printing apparatus according to claim 2, wherein horizontal distance between two adjacent teeth of the comb teeth, which sandwich the tablet T conveyed by the conveyor belt, is larger than maximum size of the tablet in the horizontal direction.

4. The tablet printing apparatus according to claim 2, wherein the comb teeth are located above the tablet passing as being conveyed by the conveyor belt, and are arranged in the control plate so as not to contact the tablet.

5. The tablet printing apparatus according to claim 1, wherein a plurality of through holes are formed in the control plate so as to penetrate the control plate in the conveying direction of the tablet.

6. The tablet printing apparatus according to claim 1, wherein a part of lower end of the control plate is located at a position higher than upper surface of the conveyor belt and lower than apex of the tablet on the conveyor belt.

7. The tablet printing apparatus according to claim 1, further comprising:

a housing configured to house the print head; and a gas blower and a gas suction unit arranged on an upstream side of the print head in the conveying direction of the tablet, wherein the gas blower is configured to blow a gas to upper surface of the conveyor belt, and the gas suction unit is configured to suck the gas blown by the gas blower.

8. A tablet printing apparatus, comprising:

a conveyor belt including a suction hole connected to a suction chamber, and configured to convey a tablet while sucking the tablet to the suction hole;

an ink jet print head having a nozzle surface where a nozzle is formed, located above the conveyor belt such that the nozzle surface faces the conveyor belt, and configured to perform printing on the tablet conveyed by the conveyor belt; and a control plate located on an upstream side of the print head in a conveying direction of the tablet between the conveyor belt and a height position of the nozzle surface of the print head, and configured to control an airflow generated between the conveyor belt and the print head, wherein the control plate includes a blocking portion configured to block an airflow generated between the conveyor belt and the print head and flowing along the conveying direction of the tablet, and an opening portion through which the airflow passes.

9. The tablet printing apparatus according to claim 8, wherein a plurality of comb teeth is formed in an end portion of the control plate on conveyor belt side so as to be aligned along a direction crossing the conveying direction of the tablet in a horizontal plane.

10. The tablet printing apparatus according to claim 9, wherein horizontal distance between two adjacent teeth of the comb teeth, which sandwich the tablet T conveyed by the conveyor belt, is larger than maximum size of the tablet in the horizontal direction.

11. The tablet printing apparatus according to claim 9, wherein the comb teeth are located above the tablet passing as being conveyed by the conveyor belt, and are arranged in the control plate so as not to contact the tablet.

12. The tablet printing apparatus according to claim 8, wherein a plurality of through holes are formed in the control plate so as to penetrate the control plate in the conveying direction of the tablet.

13. The tablet printing apparatus according to claim 8, wherein a part of lower end of the control plate is located at a position higher than upper surface of the conveyor belt and lower than apex of the tablet on the conveyor belt.

14. The tablet printing apparatus according to claim 8, further comprising:

a housing configured to house the print head; and a gas blower and a gas suction unit arranged on an upstream side of the print head in the conveying direction of the tablet, wherein the gas blower is configured to blow a gas to upper surface of the conveyor belt, and the gas suction unit is configured to suck the gas blown by the gas blower.

* * * * *